US007712693B2

(12) United States Patent
Hall

(10) Patent No.: US 7,712,693 B2
(45) Date of Patent: May 11, 2010

(54) DEGRADATION INSERT WITH OVERHANG

(76) Inventor: David R. Hall, 2185 South Larsen Parkway, Provo, UT (US) 84606

( * ) Notice: Subject to any disclaimer, the term of this patent is extended or adjusted under 35 U.S.C. 154(b) by 81 days.

(21) Appl. No.: 12/098,934

(22) Filed: Apr. 7, 2008

(65) Prior Publication Data

US 2008/0185468 A1 Aug. 7, 2008

Related U.S. Application Data

(63) Continuation of application No. 12/051,689, filed on Mar. 19, 2008, which is a continuation-in-part of application No. 12/051,586, filed on Mar. 19, 2008, which is a continuation of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 12/098,934, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*B02C 2/00* (2006.01)

(52) U.S. Cl. ..... 241/207; 241/300

(58) Field of Classification Search ..... 241/300, 241/207–216, 264–269
See application file for complete search history.

(56) References Cited

U.S. PATENT DOCUMENTS 883,619 A * 3/1908 Canda ..... 241/294

(Continued)

FOREIGN PATENT DOCUMENTS

DE 3500261 7/1986

(Continued)

*Primary Examiner*—Mark Rosenbaum
(74) *Attorney, Agent, or Firm*—Tyson J. Wilde

(57) ABSTRACT

In one aspect of the invention, a cone crusher has at least one crushing surface disposed on either a cone and/or an inverted bowl of the crusher. The crushing surface has at least one insert having an impact head with a stem protruding from a base end of the head. The stem has a smaller cross sectional thickness than the head.

16 Claims, 11 Drawing Sheets

U.S. PATENT DOCUMENTS 2,004,315 A 6/1935 Fean
2,124,438 A 7/1938 Struk
3,241,777 A * 3/1966 Kuntz ..... 241/300
3,254,392 A 6/1966 Novkov
3,746,396 A 7/1973 Radd
3,807,804 A 4/1974 Kniff
3,830,321 A 8/1974 McKenry
3,932,952 A 1/1976 Helton
3,945,681 A 3/1976 White
4,005,914 A 2/1977 Newman
4,006,936 A 2/1977 Crabiel
4,098,362 A 7/1978 Bonnice
4,109,737 A 8/1978 Bovenkerk
4,156,329 A 5/1979 Daniels
4,199,035 A 4/1980 Thompson
4,201,421 A 5/1980 Den Besten
4,277,106 A 7/1981 Sahley
4,439,250 A 3/1984 Acharya
4,465,221 A 8/1984 Schmidt
4,484,644 A 11/1984 Cook
4,489,986 A 12/1984 Dziak
4,678,237 A 7/1987 Collin
4,682,987 A 7/1987 Brady
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,261,499 A 11/1993 Grubb
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jenson
5,967,250 A 10/1999 Lund
5,992,405 A 11/1999 Sollami
6,006,846 A 12/1999 Tibbitis
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,123,279 A * 9/2000 Stafford et al. ..... 241/30
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,692,083 B2 2/2004 Latham
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,889,890 B2 5/2005 Yamazaki
6,966,611 B1 11/2005 Sollami
6,994,404 B1 2/2006 Sollami
7,204,560 B2 4/2007 Mercier
2002/0175555 A1 11/2002 Mercier
2003/0141350 A1 7/2003 Noro et al.
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshta

FOREIGN PATENT DOCUMENTS

DE 3818213 11/1989
DE 4039217 6/1992
DE 19821147 11/1999
DE 10163717 5/2003
EP 0295151 6/1988
EP 0412287 7/1990
GB 2004315 3/1979
GB 2037223 11/1979
JP 3123193 1/2001

* cited by examiner

DEGRADATION INSERT WITH OVERHANG

CROSS REFERENCE TO RELATED APPLICATIONS

This application is a continuation of U.S. patent application Ser. No. 12/051,689 filed on Mar. 19, 2008 which is a continuation-in-part of U.S. patent application Ser. No. 12/051,586 filed on Mar. 19, 2008 which is a continuation of U.S. patent application Ser. No. 12/021,051 filed on Jan. 28, 2008 which is a continuation-in-part of U.S. patent application Ser. No. 12/021,019 filed on Jan. 28, 2008 which was a continuation-in-part of U.S. patent application Ser. No. 11/971,965 filed on Jan. 10, 2008 now U.S. Pat. No. 7,648,210 which is a continuation of U.S. patent application Ser. No. 11/947,644, filed on Nov. 29, 2007 which was a continuation-in-part of U.S. patent application Ser. No. 11/844,586 filed on Aug. 24, 2007 now U.S. Pat. No. 7,600,823 U.S. patent application Ser. No. 11/844,586 is a continuation-in-part of U.S. patent application Ser. No. 11/829,761 filed on Jul. 27, 2007 U.S. patent application Ser. No. 11/829,761 is a continuation-in-part of U.S. patent application Ser. No. 11/773,271 filed on Jul. 3, 2007 U.S. patent application Ser. No. 11/773,271 is a continuation-in-part of U.S. patent application Ser. No. 11/766,903 filed on Jun. 22, 2007 U.S. patent application Ser. No. 11/766,903 is a continuation of U.S. patent application Ser. No. 11/766,865 filed on Jun. 22, 2007 U.S. patent application Ser. No. 11/766,865 is a continuation-in-part of U.S. patent application Ser. No. 11/742,304 filed on Apr. 30, 2007 now U.S. Pat. No. 7,475,948 U.S. patent application Ser. No. 11/742,304 is a continuation of U.S. patent application Ser. No. 11/742,261 filed on Apr. 30, 2007 now U.S. Pat No. 7,469,971 U.S. patent application Ser. No. 11/742,261 is a continuation-in-part of U.S. patent application Ser. No. 11/464,008 filed on Aug. 11, 2006 now U.S. Pat. No. 7,338,135 U.S. patent application Ser. No. 11/464,008 is a continuation-in-part of U.S. patent application Ser. No. 11/463,998 filed on Aug. 11, 2006 now U.S. Pat. No. 7,384,105 U.S. patent application Ser. No. 11/463,998 is a continuation-in-part of U.S. patent application Ser. No. 11/463,990 filed on Aug. 11, 2006 now U.S. Pat. No. 7,320,505 U.S. patent application Ser. No. 11/463,990 is a continuation-in-part of U.S. patent application Ser. No. 11/463,975 Filed on Aug. 11, 2006 now U.S. Pat. No. 7,445,294 U.S. patent application Ser. No. 11/463,975 is a continuation-in-part of U.S. patent application Ser. No. 11/463,962 filed on Aug. 11, 2006 now U.S. Pat No. 7,413,256 U.S. patent application Ser. No. 11/463,962 is a continuation-in-part of U.S. patent application Ser. No. 11/463,953 filed on Aug. 11, 2006 now U.S. Pat. No. 7,464,993 The present application is also a continuation-in-part of U.S. patent application Ser. No. 11/695,672, filed Apr. 3, 2007, now U.S. Pat. No. 7,396,086. U.S. patent application Ser. No. 11/695,672 is a continuation-in-part of U.S. patent application Ser. No. 11/686,831 filed on Mar. 15, 2007 now U.S. Pat. No. 7,568,770. All of these applications are herein incorporated by reference for all that they contain. Also U.S. patent application Ser. No. 11/561,827 which is a continuation-in-part of U.S. patent application Ser. No. 11/424,833 and U.S. patent application Ser. No. 11/426,202 is a continuation-in-part of U.S. patent application Ser. No. 11/426,202. These references are also herein incorporated by reference for all that they disclose.

BACKGROUND OF THE INVENTION

Replaceable wear liners are often incorporated into cone crushers to form the crushing surfaces used to crush various materials. Cone crushers typically comprise of an assembly that rotates about a stationary shaft resulting in a gyratory motion which is harnessed to crush material as it traverses between crushing surfaces in the crushing chamber where the replaceable wear liners are located. Material to be crushed is effectively reduced into smaller dimensions as a result of being subjected to compression between the tapered crushing surfaces of the crushing chamber. The reduced material then exits from a gap between the crushing surfaces sometimes called the "closed side setting" where the minimum width of the reduced material is predetermined by manipulating the closed side setting in accordance with the desired geometry of the reduced material. The final product consists of material that possesses the desired geometry or ratio of length to width to thickness for various applications such as road surfacing, paving, landscaping and so forth.

Over time the replaceable wear liner may begin to deteriorate such that the space between the crushing surfaces become distorted which consequently reduces the crushers ability to produce the desired geometry resulting in irregular or substandard final product material. Substandard product may require that the replaceable wear liner be serviced or replaced. Consequently, the time required to properly address wear issues equates to significant economic loss both in terms of maintenance and production loss.

In the prior art, U.S. Pat. Nos. 5,967,431 and 6,123,279 as well as U.S. Patent Publication Nos. 2003/0136865, 2008/0041994 and 2008/0041995 are herein incorporated by reference for all that they contain which disclose cone crushers that may be compatible with the present invention. U.S. Patent Publication No. 2008/0041992 and 2008/0041993 are also incorporated by reference for all that they contain.

BRIEF SUMMARY OF THE INVENTION

In one aspect of the invention, a cone crusher has at least one crushing surface disposed on either a cone and/or an inverted bowl of the crusher. The crushing surface has at least one insert having an impact head with a stem protruding from a base end of the head. The stem has a smaller cross sectional thickness than the head.

The stem and head may be made from the same material. The stem and head may be made of two dissimilar materials. The material of the stem may have a coefficient of thermal expansion greater than a coefficient of thermal expansion of the material of the head. A material of the stem may have a coefficient of thermal expansion equal to or greater than a coefficient of thermal expansion of a material of the cavity.

The base end of the head may be adapted to protect a region of the crushing surface proximate the stem. A cavity formed in the crushing surface may have a seat complimentary to the base end of the head. The stem may be press-fit into a cavity formed in the crushing surface. The insert may be threaded into a cavity formed in the crushing surface.

A plurality of inserts may be packed in proximity to each other on the crushing surface. The insert may have at least one flat to accommodate packing. An overhang formed by the base end of the insert may contact the crushing surface.

The stem and head may be interlocked. The stem may have a collar at a second end of the stem adapted to be press-fitted within a cavity formed in the crushing surface. The head may have a recess formed in its base end and is adapted to interlock with the stem. The stem may have a locking mechanism adapted to interlock a first end of the stem within the recess. The locking mechanism may have a radially extending catch formed in the first end of the stem. The cavity may have an inwardly protruding catch. The inwardly protruding catch may be adapted to interlock with the radially extending catch. A snap ring may be intermediate the inwardly protruding catch and the radially extending catch. A locking fixture may be disposed within a cavity formed in the crushing surface and locks the stem to a wall of the cavity. The base end of the head may have an upward extending taper. The impact head may have a plurality of layered materials.

A crusher may have at least one crushing surface. The crushing surface may have at least one insert having an impact head with a stem protruding from a base end of the head. The stem may have a smaller cross sectional thickness than the head.

DETAILED DESCRIPTION OF THE INVENTION AND THE PREFERRED EMBODIMENT

Figure 1:
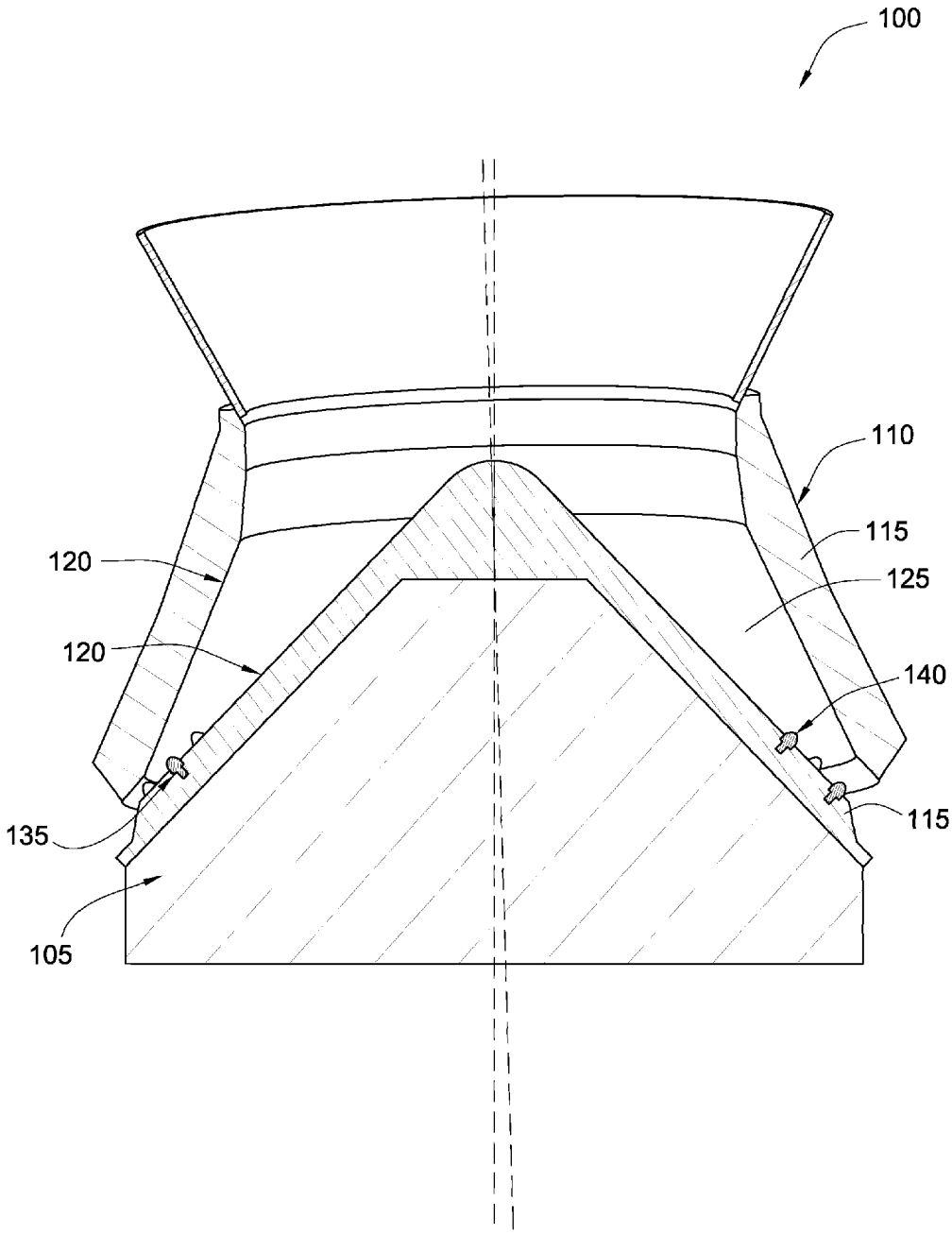
FIG. 1 is a perspective cross-sectional diagram of an embodiment of a cone crusher with a replaceable wear liner.

FIG. 1 depicts a cone crusher 100 in accordance with the present invention. The cone crusher 100 may comprise at least one disposable replaceable wear liner 115 configured for either a conical head 105 or a concave bowl 110. The concave bowl 110 is typically connected to a hopper for receiving aggregate such as rock. The conical head 105 and concave bowl 110 may each comprise replaceable wear liners 115 comprised of a material selected from the group consisting of manganese, steel, stainless steel, carbide, and combinations thereof, which form the crushing surfaces 120 of the crushing chamber 125. Inserts are incorporated into the wear liner and may serve to enhance resistance to wear and may assist to prolong the life of the replaceable wear liner 115. The inserts may also be used to break the aggregate passing through the crusher such that the aggregate is preferentially shaped. In some embodiments the inserts comprise carbide, a cemented metal carbide, diamond, vapor deposited diamond, sintered diamond, hardened steel, cubic boron nitride, manganese, ceramics, silicon carbide, and combinations thereof. The crushing surface 120 of the replaceable wear liner 115 may also comprise of a plurality of cavities 135 which are formed to accept the inserts 140. The inserts 140 may be incorporated in at least one of the replaceable wear liners 115 extending from one crushing surface 120 towards another opposing crushing surface 120 and may be disposed in such a way to provide optimal disintegration of crushing material while also providing enhanced wear resistance for the replaceable wear liner 115. The inserts 140 may be brazed or press fit within the cavities 135. The inserts 140 may protrude out of the crushing surface 120 at a range between 0.100 to 3.00 inches depending on the material to be reduced. In some embodiments the inserts 140 do not protrude at all from the crushing surface 120 but are flush or retracted within the cavity 135. The diameter of the inserts 140 may range from 3 mm to 19 mm.

The inserts 114 may be populated over the entire surface area of either the conical head 105 or the concave bowl 110. In some embodiments, only areas susceptible to high wear are populated.

Figure 2:
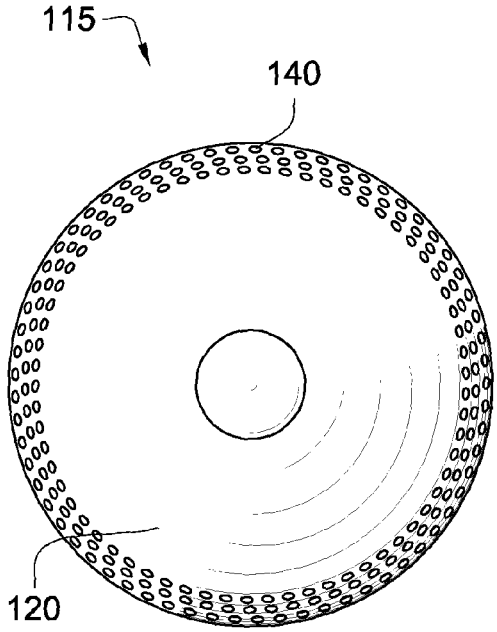
FIG. 2 is top perspective diagram of an embodiment of a conical head replaceable wear liner.
Figure 3:
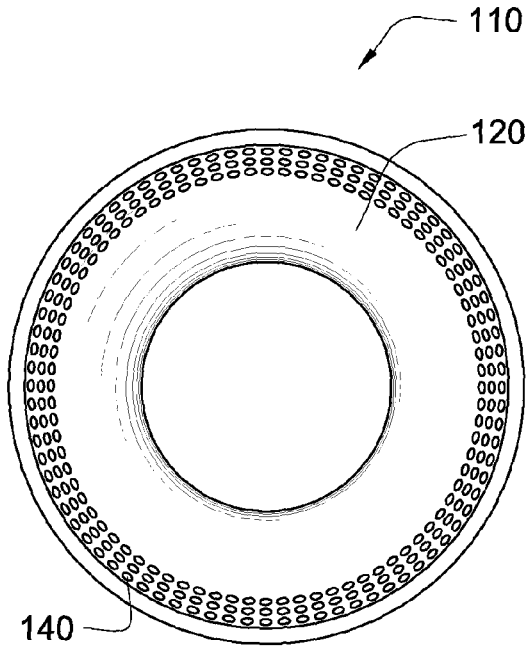
FIG. 3 is top perspective diagram of an embodiment of a concave bowl replaceable wear liner.
Figure 4:
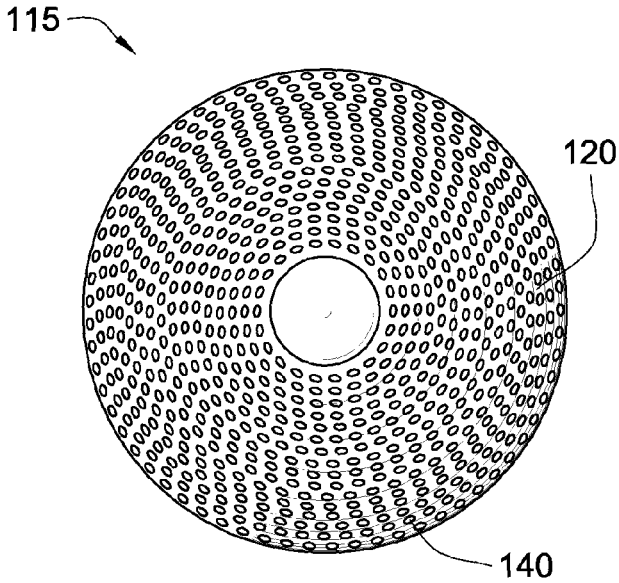
FIG. 4 is top perspective diagram of another embodiment of a conical head replaceable wear liner.

FIG. 2 is another embodiment of a cone crusher 100 depicting a replaceable wear liner 115 of a conical head 105 where the arrangement of inserts 140 are disposed in circular rows around the lower portion of the replaceable wear liner 115. FIG. 3 is an embodiment of a replaceable wear liner 115 of a concave bowl 105 depicting the arrangement of inserts 140 also being disposed in circular rows around the lower portion of the replaceable wear liner 115. The rows may align with each other or the rows may be offset from one another. In some embodiments, the lower rows may comprise more inserts 140 than the upper rows. The preferred embodiment is to have the inserts 140 disposed within the lower peripheral circumference of the replaceable wear liner 115 of conical head 105 where the liner is most susceptible to wear. This preferred embodiment may assist to counter the erosive deterioration of the replaceable wear liner and improve consistency of the geometry of the size reduced aggregate. Yet in other embodiments it may also be advantageous to have the inserts 140 disposed within the upper portions of the replaceable wear liner 115 of both the conical head 105 and concave bowl 110 or combinations thereof. FIG. 4 discloses an embodiment of a replaceable wear liner 115 of a conical head 105 where the arrangement of inserts 140 are disposed in circular rows around the lower portion and the upper portion of the replaceable wear liner 115.

Figure 5:
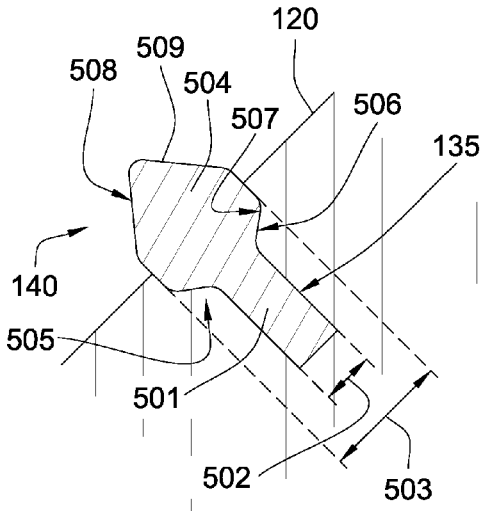
FIG. 5 is a cross-sectional diagram of an embodiment of an insert.
Figure 6:
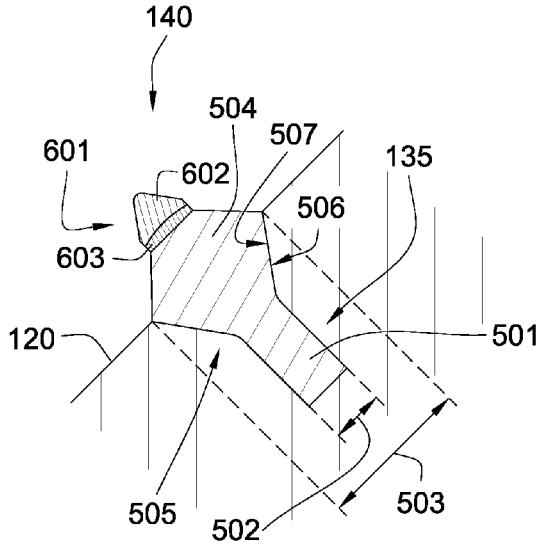
FIG. 6 is a cross-sectional diagram of another embodiment of an insert.
Figure 7:
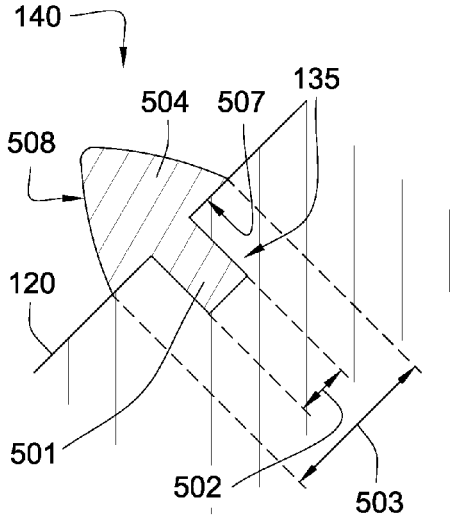
FIG. 7 is a cross-sectional diagram of another embodiment of an insert.
Figure 8:
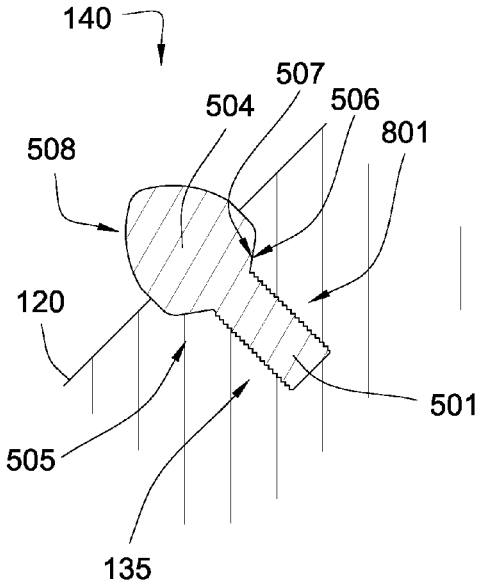
FIG. 8 is a cross-sectional diagram of another embodiment of an insert.
Figure 9:
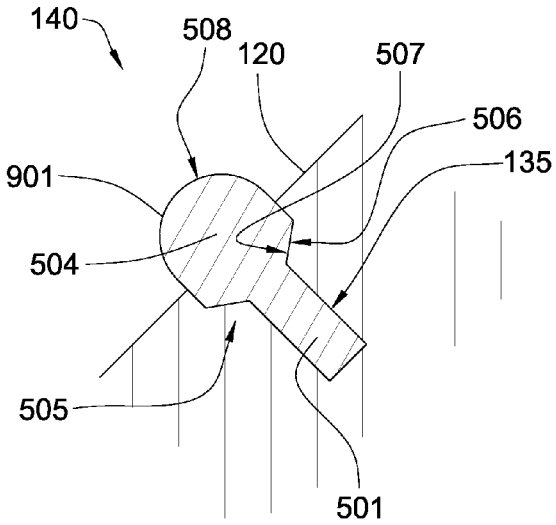
FIG. 9 is a cross-sectional diagram of another embodiment of an insert.
Figure 10:
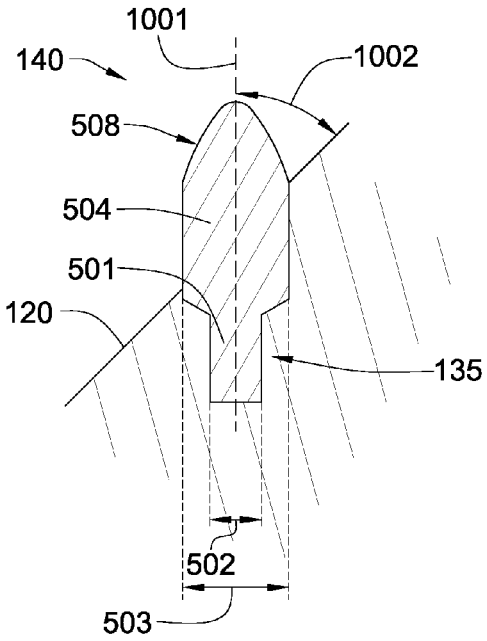
FIG. 10 is a cross-sectional diagram of another embodiment of an insert.

Referring now to FIGS. 5 through 6, the insert 140 comprises an impact head 504 with a stem 501 protruding from a base end 505 of the head 504. The stem 501 may be press fit into the cavity 135. The stem 501 may be retained within the cavity 135 by a braze. The stem 501 comprises a smaller cross sectional thickness 502 than a cross sectional thickness 503 of the head 504 causing an overhang 507 to be formed by the base end 505 of the head 504. It is believed that the overhang 507 in the base end 505 of the head 504 will protect a region of the crushing surface 120 proximate the stem 501. In the prior art, inserts incorporated in cone crushers are susceptible to failure since the inserts fall out when the crushing surface immediately proximate to them wear away leaving the inserts little or no support. Since the overhang protects the volume of the crushing surface which supports the inserts, the inserts will remain in the crushing surface longer and such that they will continue to protect the crushing surface longer and enable the aggregate to be crushed preferentially as well. The region of the crushing surface 120 proximate the stem 501 may include at least all of the material of the replaceable wear liner 115 directly below the overhang 507. The base end 505 of the head 504 may comprise an upward extending taper. The cavity 135 may comprise a seat 506 complimentary to the base end 505 of the head 504. It is believed that the base end 505 with the upward extending taper and the complimentary seat 506 will provide side support to the insert 140 and preferentially distribute impact forces as the insert 140 contacts the aggregate.

In some embodiments, the cross-sectional thickness of the head is at least twice the thickness of the stem. In some embodiments the cross-sectional thicknesses are diameters.

The stem 501 and head 504 may be made from the same material and may be formed from a single piece of material. The stem 501 and head 504 also may be made of two dissimilar materials. In the case of the head 504 and stem 501 being made from two dissimilar materials, the material of the stem 501 may have a coefficient of thermal expansion greater than a coefficient of thermal expansion of the material of the head 504. The material of the stem 501 may have a coefficient of thermal expansion equal to or greater than a coefficient of thermal expansion of a material of the cavity 135. It is believed that if the coefficient of thermal expansion of the stem 501 material is equal to or greater than the coefficient of thermal expansion of the cavity 135 material that a press fit connection between the stem 501 and the cavity 135 will not be compromised as the replaceable wear liner 115 increases in temperature due to friction or working conditions. This is also solves another problem of the prior when inserts fall out of the crushing surface as the crushing surface (which has a greater coefficient of thermal expansion) increases more than the inserts and thereby allow the inserts to fall out. In the preferred embodiment, the coefficients of thermal expansion between the stem and the crushing surface are within 10 percent. In some embodiments, if the coefficients of thermal expansion are more then 50 percent the stems 501 may loose their press fit and potentially fall out of the cavities 135. The benefits of similar coefficients allow for a more optimized press fit.

The head 504 comprises a working surface 508 with a generally conical geometry 509. The head 504 may also comprise a plurality of layered materials 601. The plurality of layered materials 601 may comprise a diamond layer 602 bonded to a cemented metal carbide substrate layer 603. The diamond layer 602 comprises a volume greater than a volume of the carbide substrate layer 603. In some embodiments the diamond layer 602 may comprise a volume that is 75% to 175% of a volume of the carbide substrate layer 603. The diamond layer 602 may be a material selected from the group consisting of diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. The diamond layer 602 may be bonded to a carbide substrate which may in turn be bonded to the head of the insert. The diamond layer may be between 0.100 and 0.400 inches thick, preferably between 0.150 and 0.275 inches thick. The substrate by between 20 and 2 mm thick. The diamond layer 602 may comprise an average diamond grain size of 1 to 100 microns.

The diamond layer 602 comprises a substantially conical geometry with an apex. Preferably, the interface between the substrate layer 603 and the diamond layer 602 is non-planar, which may help distribute loads on the plurality of layered materials 601 across a larger area of the interface.

Referring now to FIGS. 7 through 10, the overhang 507 overhang formed by the base end 505 of the head 504 may contact the crushing surface 120. The stem 501 and cavity 135 may also be threaded 801 so that the insert 140 may be threaded into the cavity 135. The working surface 508 of the head 504 may comprise generally hemispherical geometry 901. At least one of the inserts 140 may be mounted in the replaceable wear liners 115 such that a central axis 1001 of the insert 140 and the crushing surface 120 form an angle 1002 greater than or less than 90 degrees.

Figure 11:
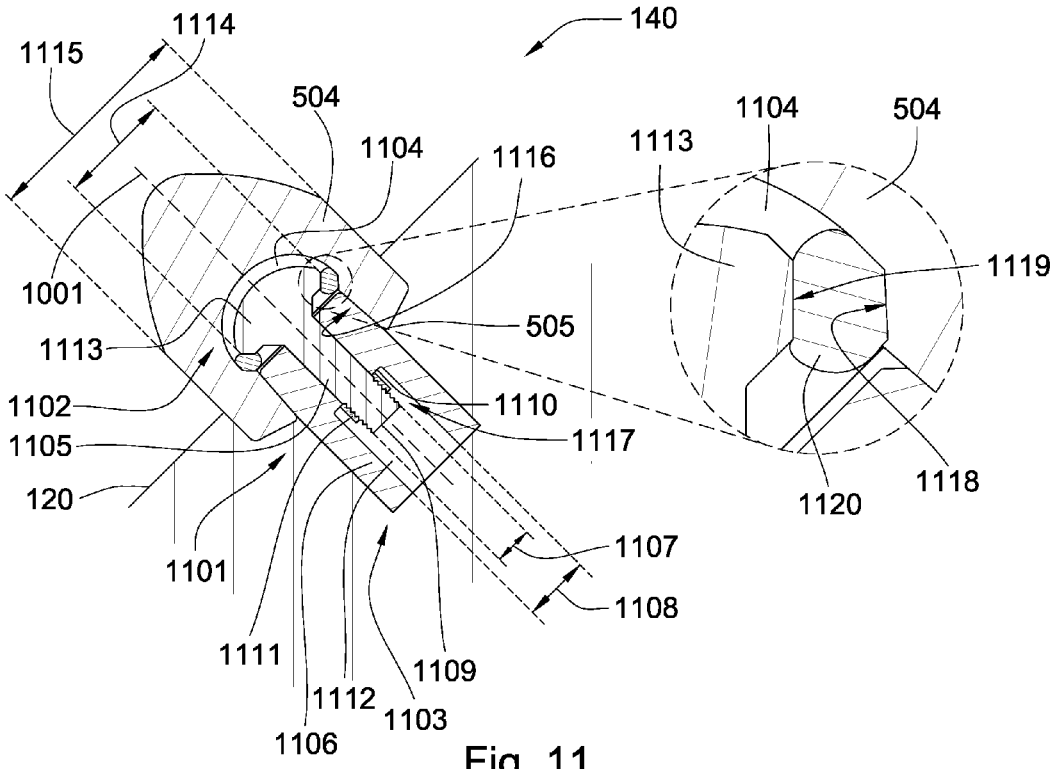
FIG. 11 is a cross-sectional diagram of another embodiment of an insert.

Referring now to FIG. 11, the insert 140 may comprise the head 504 and a stem assembly 1101 comprising a first end 1102 and a second end 1103. The head 504 is adapted to interlock with the stem assembly 1101. The first end 1102 of the stem assembly 1101 may be adapted to fit into a recess 1104 formed in the base end 505 of the head 504. In FIG. 11 the stem assembly 1101 is generally cylindrical. The second end 1103 of the stem assembly 1101 is press-fitted into the cavity 135 of the replaceable wear liner 115.

The stem assembly 1101 may comprise a hard material such as steel, stainless steel, hardened steel, or other materials of similar hardness. The head 504 may comprise tungsten, titanium, tantalum, molybdenum, niobium, cobalt and/or combinations thereof.

The stem assembly 1101 may be work-hardened or cold-worked in order to provide resistance to cracking or stress fractures due to forces exerted on the insert 140 by the crushing material. The stem assembly 1101 may be work-hardened by shot-peening or by other methods of work-hardening. At least a portion of the stem assembly 1101 may also be work-hardened by stretching it during the manufacturing process. In some embodiments, the stem assembly may be tensioned.

The stem assembly 1101 comprises a locking mechanism 1112 and a collar 1106. The locking mechanism 1112 is axially disposed within a bore 1107 of the collar 1106 and the second end 1103 of the locking mechanism 1112 is secured within or below the bore 1107. The first end 1102 of the locking mechanism 1112 protrudes into the recess 1104 in the base end 505 of the head 504 and the first end 1102 of the collar 1106 may be adapted to fit into the recess 1104 in the base end 505 of the head 504. The locking mechanism 1112 is adapted to lock the first end 1102 of the stem assembly 1101 within the recess 1104. The locking mechanism 1112 may attach the stem assembly 1101 to the head 504 and restrict movement of the stem assembly 1101 with respect to the head 504. The locking mechanism 1112 comprises a radially extending catch 1119 that is formed in the first end 1102 of the stem assembly 1101. The stem assembly 1101 may be prevented by the locking mechanism 1112 from moving in a direction parallel to the central axis 1001 of the insert 140. In some embodiments the stem assembly 1101 may be prevented by the locking mechanism 1112 from rotating about the central axis 1001.

The recess 1104 may comprise an inwardly protruding catch 1118. A snap ring 1120 is disposed intermediate the inwardly protruding catch 1118 of the recess 1104 and the radially extending catch 1119 of the first end 1102 of the locking mechanism 1112. In some embodiments the snap ring 1120 is a flexible ring 1120. In some embodiments the snap ring 1120 may be a split ring, coiled ring, a flexible ring or combinations thereof. In FIG. 11 the locking mechanism 1112 comprises a locking shaft 1105. The locking shaft 1105 is connected to an expanded locking head 1113. In some embodiments the radially extending catch 1119 is an undercut formed in the locking head 1113. The snap ring 1120 and locking head 1113 are disposed within the recess 1104 of the head 504. The locking shaft 1105 protrudes from the recess 1104 and into an inner diameter 1108 of the stem assembly 1101. The locking shaft 1105 is disposed proximate the bore 1107 proximate the first end 1102 of the stem assembly 1101. The locking shaft 1105 is adapted for translation in a direction parallel to the central axis 1001 of the stem assembly 1101. The locking shaft 1105 may extend from the recess 1104 and the snap ring 1120 may be inserted into the recess 1104.

When the first end 1102 of the locking mechanism 1112 is inserted into the recess 1104, the locking head 1113 may be extended away from the bore 1107 of the collar 1106. The snap ring 1120 may be disposed around the locking shaft 1105 and be intermediate the locking head 1113 and the bore 1107. The snap ring 1120 may comprise stainless steel. In some embodiments the snap ring 1120 may comprise an elastomeric material and may be flexible. The snap ring 1120 may be segments, balls, wedges, shims, a spring or combinations thereof.

The snap ring 1120 may comprise a breadth 1115 that is larger than an opening 1114 of the recess 1104. In such embodiments the snap ring 1120 may compress to have a smaller breadth 1115 than the opening 1114. Once the snap ring 1120 is past the opening 1114, the snap ring 1120 may expand to comprise its original or substantially original breadth 1115. With both the snap ring 1120 and the locking head 1113 inside the recess 1104, the rest of the first end 1102 of the stem assembly 1101 may be inserted into the recess 1104 of the head 504. Once the entire first end 1102 of the stem assembly 1101 is inserted into the recess 1104 to a desired depth, a nut 1111 may be threaded onto an exposed end 1109 of the locking shaft 1105 until the nut 1111 contacts a ledge 1110 proximate the bore 1107 mechanically connecting the locking mechanism 1112 to the collar 1106. This contact and further threading of the nut 1111 on the locking shaft 1105 may cause the locking shaft 1105 to move toward the second end 1103 of the stem assembly 1101 in a direction parallel to the central axis 1001 of the stem assembly 1101. This may also result in bringing the radially extending catch 1119 of the locking head 1113 into contact with the snap ring 1120, and bringing the snap ring 1120 into contact with the inwardly protruding catch 1118 of the recess 1104. The nut 1111 is an embodiment of a tensioning mechanism 1117. The tensioning mechanism 1117 is adapted to apply a rearward force on the first end 1102 of the stem assembly 1101. The rearward force may pull the first end 1102 of the stem assembly 1101 in the direction of the second end 1103 and applies tension along a length of the locking shaft 1105. In some embodiments the tensioning mechanism 1117 may comprise a press fit, a taper, and/or a nut 1111.

Once the nut 1111 is threaded tightly onto the locking shaft 1105, the locking head 1113 and snap ring 1120 are together too wide to exit the opening 1114. In some embodiments the contact between the locking head 1113 and the head 504 via the snap ring 1120 may be sufficient to prevent both rotation of the stem assembly 1101 about its central axis 1001 and movement of the stem assembly 1101 in a direction parallel to its central axis 1001. In some embodiments the locking mechanism 1112 is also adapted to inducibly release the stem assembly 1101 from attachment with the head 504 by removing the nut 1111 from the locking shaft 1105.

The snap ring 1120 may comprise stainless steel and may be deformed by the pressure of the locking head 1113 being pulled towards the second end 1103 of the stem assembly 1101. As the snap ring 1120 deforms it may become harder. The deformation may also cause the snap ring 1120 to be complementary to both the inwardly protruding catch 1118 and the radially extending catch 1119. This dually complementary snap ring 1120 may avoid point loading or uneven loading, thereby equally distributing contact stresses. In such embodiments the snap ring 1120 may be inserted when it is comparatively soft, and then may be work hardened while in place proximate the catches 1118, 1119.

In some embodiments at least part of the stem assembly 1101 of the insert 140 may also be cold worked. The locking mechanism 1112 may be stretched to a critical point just before the strength of the locking mechanism 1112 is compromised. In some embodiments, the locking shaft 1105, locking head 1113, and snap ring 1120 may all be cold worked by tightening the nut 1111 until the locking shaft and head 1105, 1113, and the snap ring 1120, reach a stretching critical point. During this stretching the snap ring 1120, and the locking shaft and head 1105, 1113, may all deform to create a complementary engagement, and may then be hardened in that complementary engagement. In some embodiments the complementary engagement may result in an interlocking between the radially extending catch 1119 and the inwardly protruding catch 1118.

In the embodiment of FIG. 11, both the inwardly protruding catch 1118 and the radially extending catch 1119 are tapers. Also in FIG. 11, the base end 505 of the head 504 comprises a uniform inward taper 1116.

Figure 12:
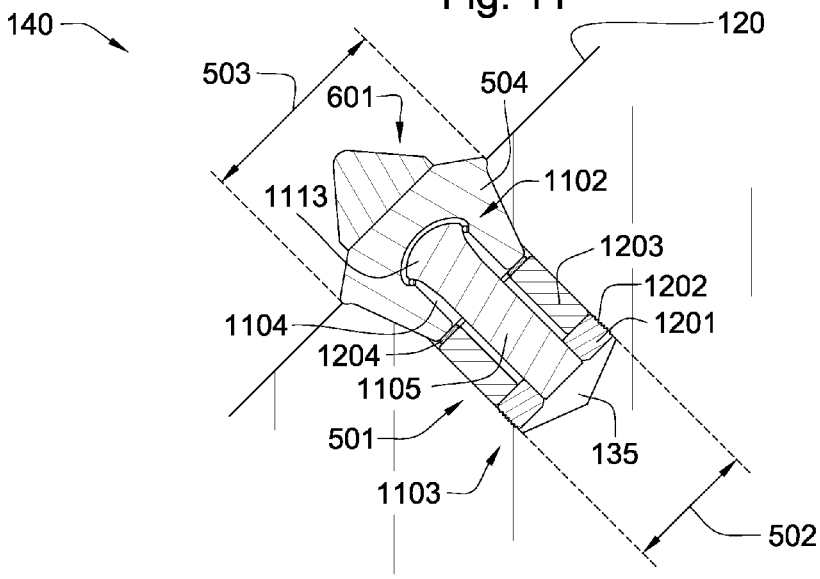
FIG. 12 is a cross-sectional diagram of another embodiment of an insert.

Referring now to FIG. 12, the collar 1106 may comprise a spacer 1203 and a locking fixture 1201. The locking fixture 1201 may be disposed proximate the second end 1103 of the stem assembly and around and connected to the locking shaft 1105. The spacer 1203 is disposed intermediate the locking fixture 1201 and the head 504 and around the locking shaft 1105. A meltable ring 1204 may be disposed intermediate the spacer 1203 and the head 504. The locking fixture 1201 may comprise barbs 1202. When the insert 140 is placed with in the cavity 135, the barbs 1202 of the locking fixture 1201 will dig into the side walls of the cavity 135 retaining the insert 140 within the cavity 135. The insert 140 may be heated such that the meltable ring 1204 melts. The melting ring 1204 may deform to a smaller thickness allowing the locking fixture

1201 to pull the head deeper into the cavity 135. The meltable ring may be made of wax, nylon, plastic, lead, tin, and combinations thereof.

Figure 13:
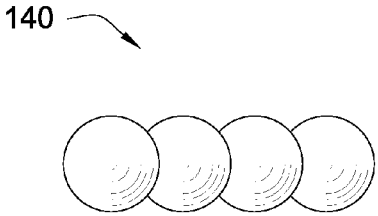
FIG. 13 is top perspective diagram of an embodiment of a plurality of packed inserts.
Figure 16:
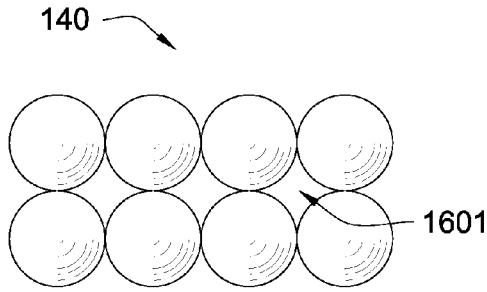
FIG. 16 is top perspective diagram of another embodiment of a plurality of packed inserts.
Figure 14:
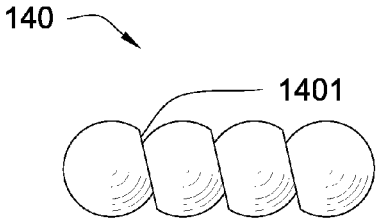
FIG. 14 is top perspective diagram of another embodiment of a plurality of packed inserts.
Figure 17:
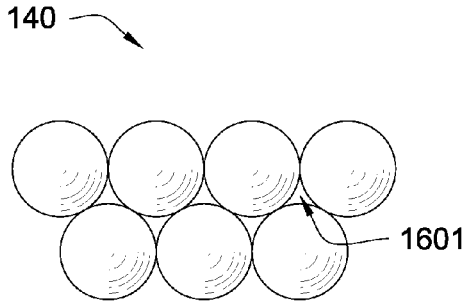
FIG. 17 is top perspective diagram of another embodiment of a plurality of packed inserts.
Figure 15:
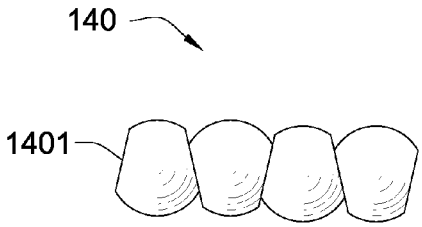
FIG. 15 is top perspective diagram of another embodiment of a plurality of packed inserts.
Figure 18:
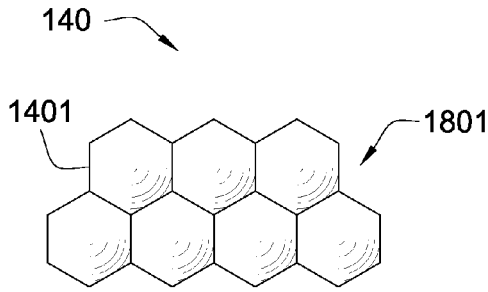
FIG. 18 is top perspective diagram of another embodiment of a plurality of packed inserts.

Referring now to FIGS. 13 though 18, a plurality of the inserts 140 may be packed in proximity to each other on the crushing surface 120. The smaller cross sectional thickness 502 of the stem 501 allows for a tight packing of the inserts 140 while maintaining a means for a strong connection between the insert 140 and the replaceable wear liner 115. FIG. 13 discloses an embodiment of a plurality of inserts 140 where at least one insert 140 comprises a generally crescent geometry so as to accommodate tight packing with a neighboring insert 140. At least one insert 140 may comprise at least one flat 1401 to accommodate packing such as in the embodiments of FIGS. 14 and 15. The inserts 140 may be packed in aligned rows such as in the embodiment of FIG. 16. The inserts 140 may also be packed in offset rows such as in FIG. 17. The inserts 140 may be packed together such that isolated portions 1601 of the crushing surface 120 are disposed amongst the packed inserts 140. It is believed that the if the crushing surface 120 is segmented into isolated portions the crushing surface 120 will be protected by the inserts 140 from the flow of crushing material thereby prolonging the life of the crushing surface 120. The inserts 140 may also comprise a hexagonal geometry 1801 to accommodate packing such as in the embodiment of FIG. 18. The inserts 140 may also comprise but are not limited to a square geometry, triangular geometry, heptagonal geometry, pentagonal geometry, octagonal geometry, or combinations thereof.

Figure 19:
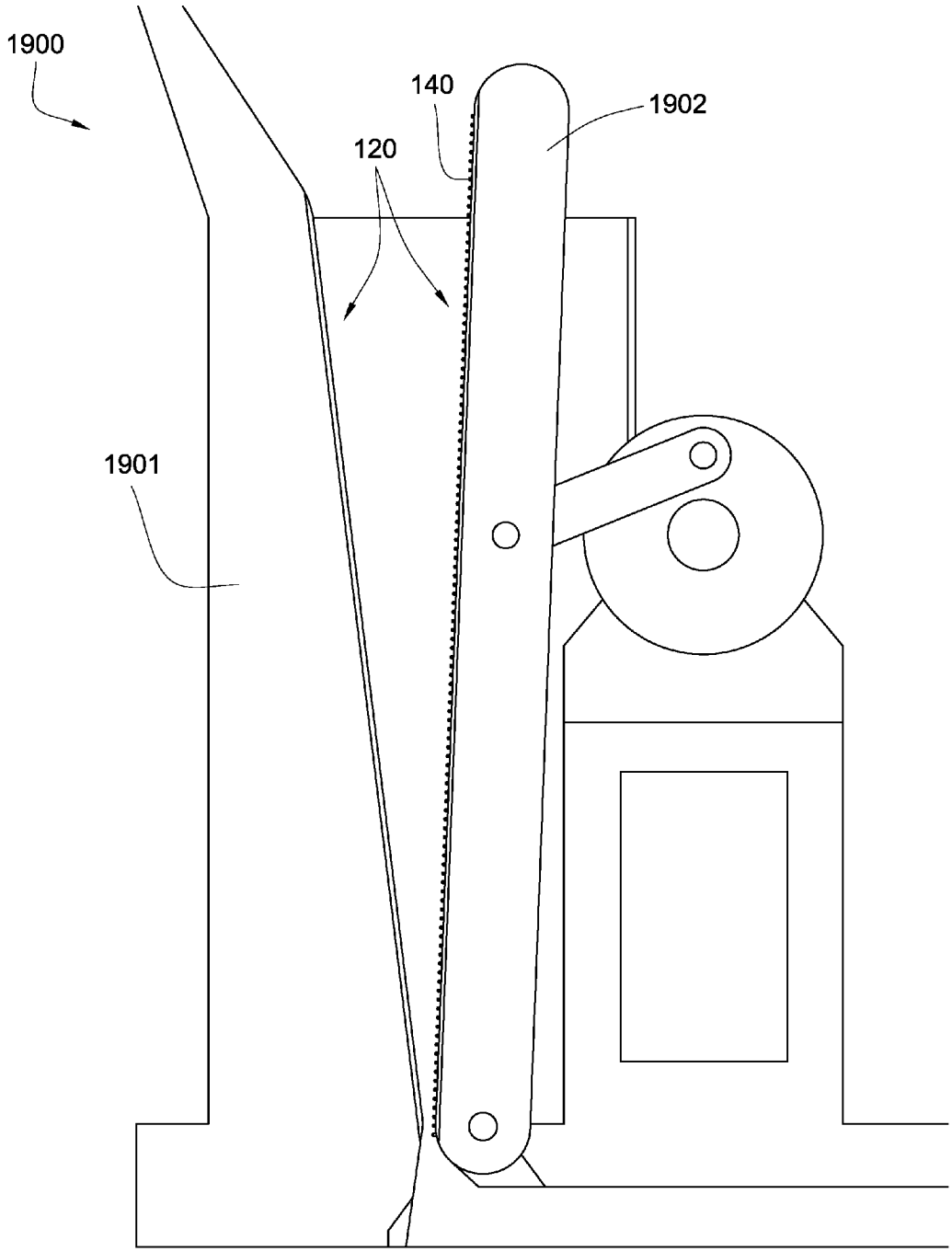
FIG. 19 is a perspective sectional diagram of an embodiment of a jaw crusher in accordance with the present invention.

FIG. 19 discloses an embodiment wherein the insert 140 may be incorporated into a jaw crusher 1900. The jaw crusher 1900 may comprise a fixed plate 1901 with a crushing surface 120 and a pivotal plate 1902 also having a crushing surface 120. Rock or other materials are reduced as they travel down the plates 1901, 1902. The inserts 140 may be fixed to the crushing surfaces 120 of the plates 1901, 1902 and may be in larger size as the inserts 140 get closer to the pivotal end of the pivotal plate 1902.

Figure 20:
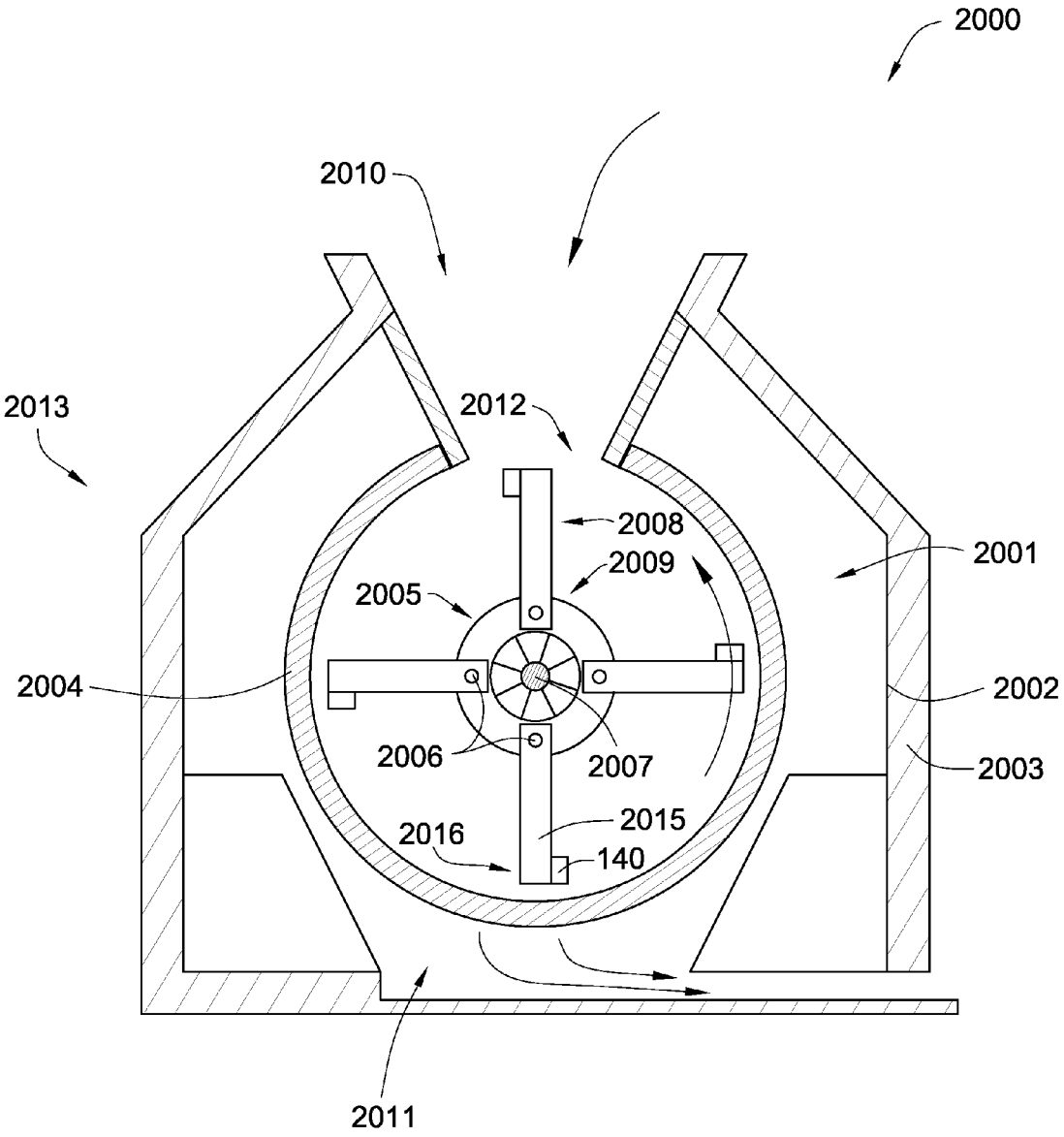
FIG. 20 is a perspective cross-sectional diagram of an embodiment of a hammer mill in accordance with the present invention.

Referring to FIG. 20, the inserts with a stem with a smaller cross-sectional area than its head may be incorporated into a hammer mill 2000. The milling chamber 2001 is defined by at least one wall 2002 of a housing 2003 which supports an internal screen 2004, which is typically cylindrical or polygonal. Within the screen 2004 a rotary assembly 2005 comprises a plurality of shafts 2006 connected to a central shaft 2007 which is in turn connected to a rotary driving mechanism (not shown). The rotary driving mechanism may be a motor typically used in the art to rotate the rotor assembly of other hammer mills. Although there are four shafts 2006 shown, two, one, or any desired number of shafts may be used. A plurality of impact hammers 2008 are longitudinally spaced and connected to each of the shafts 2006 at the hammer's proximal end 2009. The hammers 2008 may be rigidly attached to the shafts 2006 or the hammers 2008 may be free-swinging. In some embodiments, the rotor assembly 2005 comprises just the central shaft 2007 and the impact hammers 2008 are connected to it.

The housing 2003 also comprises an inlet 2010 and an outlet 2011. Typically the inlet 2010 is positioned above the rotor assembly 2007 so that gravity directs the material towards it through an opening 2012 in the screen 2004, although the inlet 2010 may instead be disposed in one of the sides 2013 of the housing 2003. When in the milling chamber 2001, a material may be reduced upon contact with the impact hammers 2008. The screen 2004 may comprise apertures (not shown) only large enough to allow the desired maximum sized particle through. Upon impact however, a distribution of particle sizes may be formed, some capable of falling through the apertures of the screen 2004 and others too large to pass through. Since the larger particle sizes may not be able pass through the apertures, they may be forced to remain within the screen 2004 and come into contact again with one of the impact hammers 2008. The hammers 2008 may repeatably contact the material until they are sized to pass through the apertures of the screen 2004.

After passage through the screen 2004 the sized reduced particles may be funneled through the outlet 2011 for collection. In other embodiments the particles may be directed towards another machine for further processing, such as when coal is the material being reduced and fine coal particles are directed towards a furnace for producing power. It may be necessary to provide low pressure in the vicinity of the outlet 2011 to remove the particles, especially the fines, through the outlet 2011. The low pressure may be provided by a vacuum.

The rotor assembly 2005 may be positioned such it is substantially perpendicular to the flow of material feed into the inlet 2010. In other embodiments, the rotor assembly 2005 may be positioned such that it is substantially parallel or diagonally disposed with respect to the flow of feed material. In some embodiments, there are multiple rotor assemblies.

Figure 21:
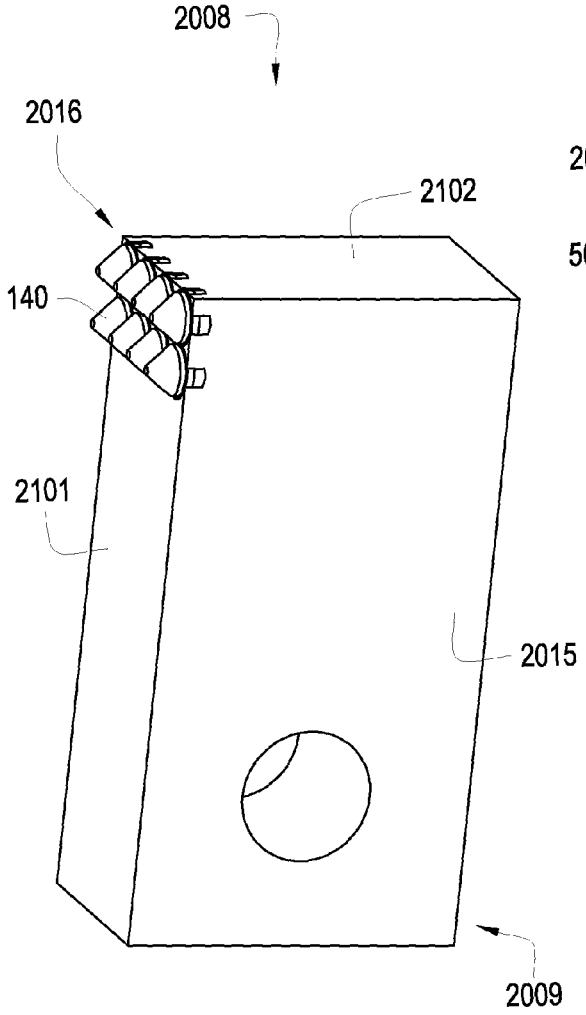
FIG. 21 is a perspective diagram of an embodiment of a hammer.
Figure 22:
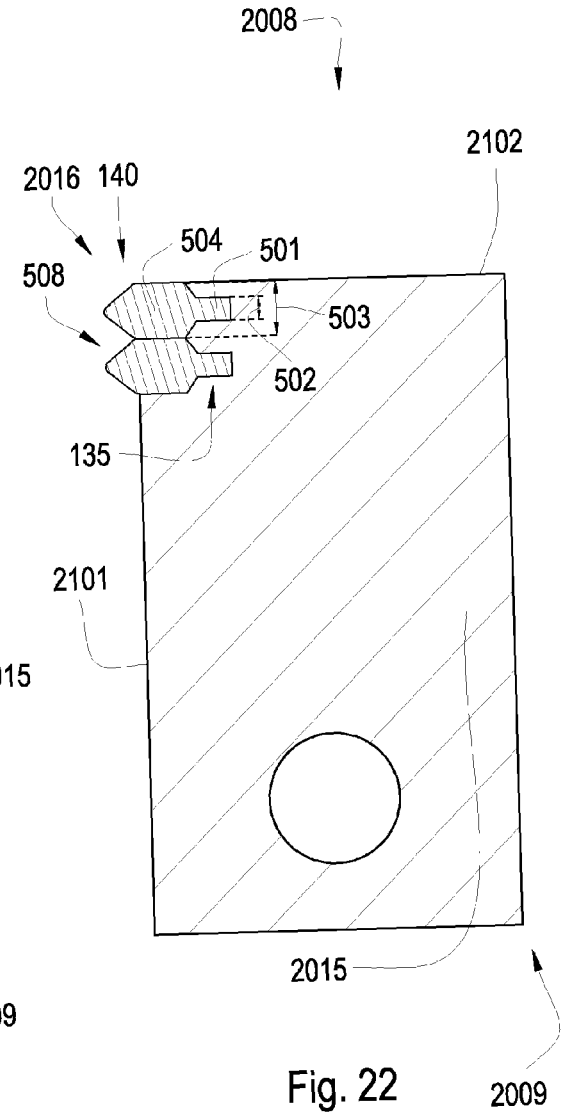
FIG. 22 is a cross-sectional diagram of another embodiment of a hammer.

Referring now to FIGS. 21 and 22, the impact hammers 2008 comprises at least one cavity 135 formed in an impact surface 2101 of the body 2015 of the impact hammer 2008 proximate a distal end 2016 of the impact hammer 2008. The insert 140 may be brazed or press fit into the cavity 135. The insert 140 may reduce wear of the hammer body 2015, which is typically more extreme at the body's 2015 distal end 2016.

The inserts 140 may be packed on the impacted surface 2101 of the hammer body 2015. The smaller cross sectional thickness 502 of the stem 501 allows for packing of the inserts 140 while maintaining a means for a strong connection between the insert 140 and the hammer body 2015. If one of the inserts 140 were to disconnect from the hammer body 2015, the connection between the hammer body 2015 and the rest of the inserts 140 would not be compromised since the other inserts were not relying entirely on the tight packing of the inserts 140 itself for support against the forces acting on the inserts.

Figure 23:
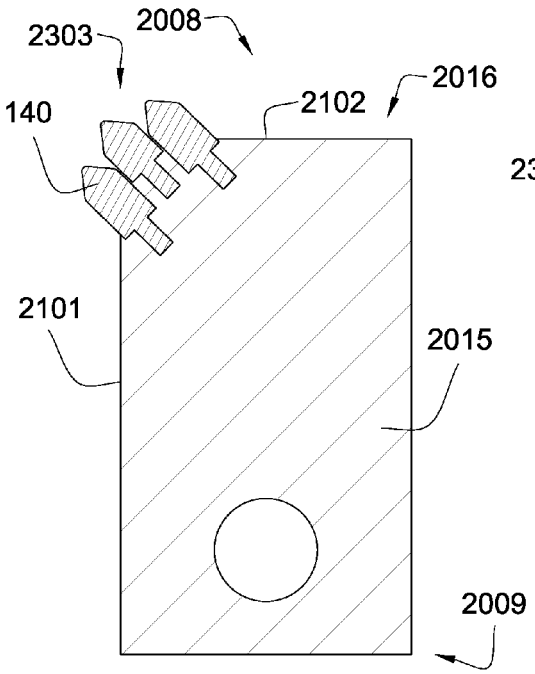
FIG. 23 is a cross-sectional diagram of another embodiment of a hammer.
Figure 24:
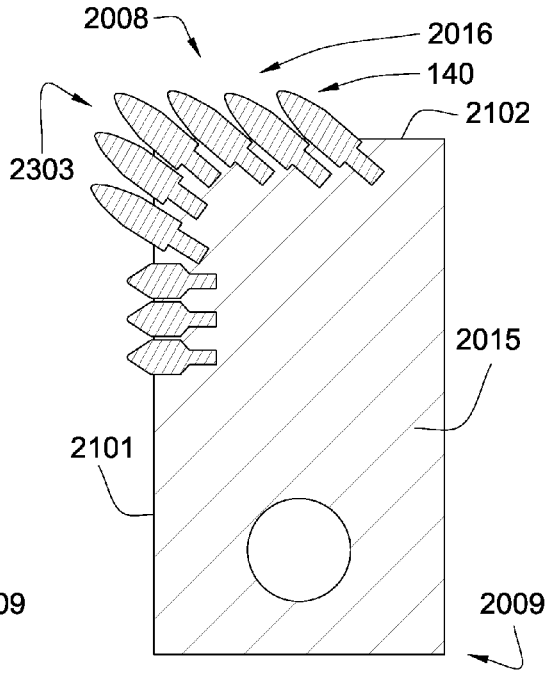
FIG. 24 is a cross-sectional diagram of another embodiment of a hammer.
Figure 25:
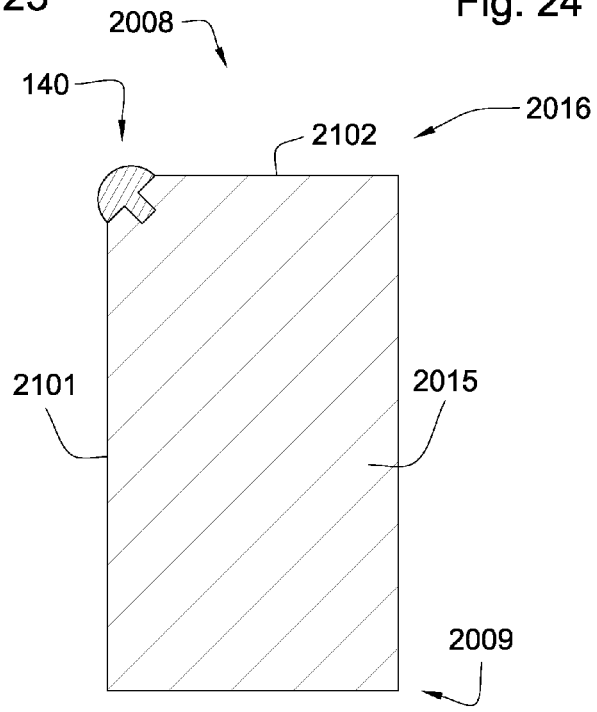
FIG. 25 is a cross-sectional diagram of another embodiment of a hammer.

Referring now to FIGS. 23 through 25, the inserts may also be mounted on a distal surface 2102, and on the corner 2303 shared by the impacted surface 2101 and the distal surface 2102. FIG. 24 discloses an embodiment wherein inserts 140 of varying geometries may be mounted to the hammer body 2015. The inserts 140 may be mounted perpendicular to the impact surface 2101 and/or distal surface 2102. The inserts 140 may also be mounted at a non-perpendicular angle to the impact surface 2101 and/or distal surface 2102. A single row of inserts 140 may be mounted to the hammer body 2015 on the corner 2303 shared by the impacted surface 2101 and the distal surface 2102.

Figure 26:
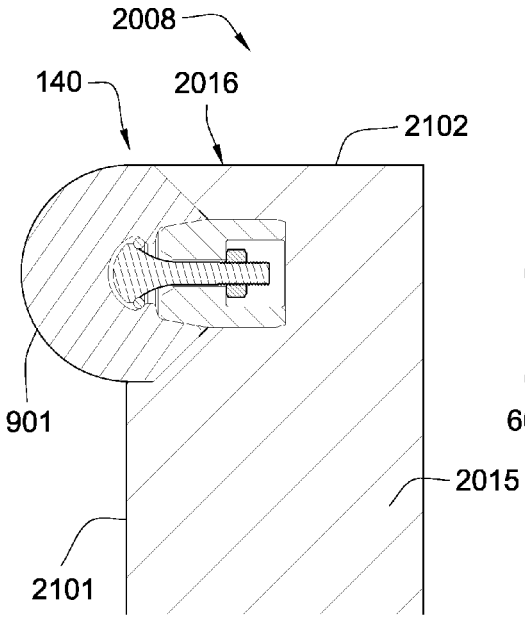
FIG. 26 is a cross-sectional diagram of another embodiment of a hammer.
Figure 27:
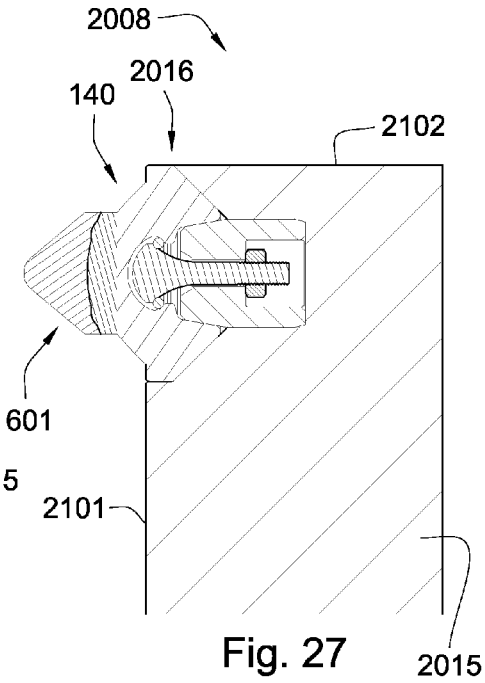
FIG. 27 is a cross-sectional diagram of another embodiment of a hammer.
Figure 28:
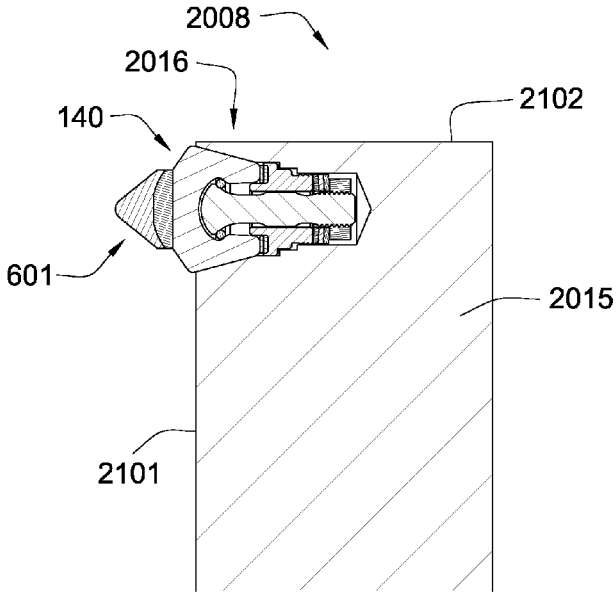
FIG. 28 is a cross-sectional diagram of another embodiment of a hammer.

Referring now to FIGS. 26 through 28, the embodiments of insert 140 disclosed in FIGS. 11 and 12 may be mounted to the hammer body 2015

Other applications not shown, but that may also incorporate the present invention include rolling mills; shaft impactors; mulchers; farming and snow plows; teeth in track hoes, back hoes, excavators, shovels; swinging picks; axes; cement drill bits; milling bits; reamers; and nose cones.

Whereas the present invention has been described in particular relation to the drawings attached hereto, it should be understood that other and further modifications apart from those shown or suggested herein, may be made within the scope and spirit of the present invention.

What is claimed is:

1. A cone crusher comprising;

at least one crushing surface disposed on either a cone and/or an inverted bowl of the crusher;

the crushing surface comprising at least one insert comprising an impact head with a stem protruding from a base end of the head, the stem being pressed into a cavity of the crushing surface;

the stem and head being made of dissimilar material, and the material of the stem having a coefficient of thermal expansion greater than a coefficient of thermal expansion of the material of the head;

an overhang formed by the base end of the insert contacts the crushing surface and protects a region of the surface;

the stem comprises a smaller cross sectional thickness than the head.

2. The crusher of claim 1, wherein the stem and head are made from the same material.

3. The crusher of claim 1, wherein the stem is press fit into a cavity formed in the crushing surface.

4. The crusher of claim 3, wherein a material of the stem has a coefficient of thermal expansion equal to or greater than a coefficient of thermal expansion of a material of the cavity.

5. The crusher of claim 1, wherein a plurality of inserts are packed in proximity to each other on the crushing surface.

6. The crusher of claim 1, wherein the insert comprises at least one flat to accommodate packing.

7. The crusher of claim 1, wherein the insert is threaded into a cavity formed in the crushing surface.

8. The crusher of claim 1, wherein the impact head comprises a plurality of layered materials.

9. The crusher of claim 1, wherein the stem and head are interlocked.

10. The crusher of claim 9, wherein the stem comprises a collar at a second end of the stem adapted to be press- fitted within a cavity formed in the crushing surface.

11. The crusher of claim 9, wherein the head comprises a recess formed in its base end and is adapted to interlock with the stem.

12. The crusher of claim 11, wherein the stem comprises a locking mechanism adapted to interlock a first end of the stem within the recess.

13. The crusher of claim 1, wherein a locking fixture is disposed within a cavity formed in the crushing surface and locks the stem to a wall of the cavity.

14. The crusher of claim 1, wherein the base end of the head comprises an upward extending taper.

15. The crusher of claim 14, wherein a cavity formed in the crushing surface comprises a seat complimentary to the base end of the head.

16. A crusher comprising;

at least one crushing surface;

the crushing surface comprising at least one insert comprising an impact head with a stem protruding from a base end of the head, the stem being pressed into a cavity of the crushing surface;

the stem and head being made of dissimilar material, and the material of the stem having a coefficient of thermal expansion greater than a coefficient of thermal expansion of the material of the head;

an overhang formed by the base end of the insert contacts the crushing surface and protects a region of the surface;

wherein the stem comprises a smaller cross sectional thickness than the head.

* * * * *